US011555253B2

(12) United States Patent
Lee et al.

(10) Patent No.: US 11,555,253 B2
(45) Date of Patent: Jan. 17, 2023

(54) PLASMA ELECTROLYTIC OXIDATION APPARATUS AND METHOD OF PLASMA ELECTROLYTIC OXIDATION USING THE SAME

(71) Applicant: KOREA INSTITUTE OF SCIENCE AND TECHNOLOGY, Seoul (KR)

(72) Inventors: Hun-su Lee, Jeollabuk-do (KR); Jaewoo Kim, Jeollabuk-do (KR); Un-Seok Jung, Jeollabuk-do (KR); Yoonsang Kim, Jeollabuk-do (KR); Yongchae Jung, Jeollabuk-do (KR); Jaesang Yu, Jeollabuk-do (KR); Yongseok Choi, Jeollabuk-do (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 17/405,018

(22) Filed: Aug. 17, 2021

(65) Prior Publication Data

US 2022/0056608 A1 Feb. 24, 2022

(30) Foreign Application Priority Data

Aug. 18, 2020 (KR) ..... 10-2020-0103167

(51) Int. Cl.
*C25D 11/00* (2006.01)
*C25D 21/12* (2006.01)
(Continued)

(52) U.S. Cl.
CPC ..... *C25D 11/005* (2013.01); *C25D 11/022* (2013.01); *C25D 11/026* (2013.01);
(Continued)

(58) Field of Classification Search
CPC ..... C25D 11/026
See application file for complete search history.

(56) References Cited

U.S. PATENT DOCUMENTS 3,546,088 A * 12/1970 Jones ..... C25D 17/02 204/224 M
6,559,069 B2 5/2003 Goldbach et al.
(Continued)

FOREIGN PATENT DOCUMENTS

DE 102018203988 A1 * 9/2019
KR 1020140073475 A 6/2014
(Continued)

OTHER PUBLICATIONS

Machine translation of DE102018203988A1 of Entelmann. (Year: 2019).*

*Primary Examiner* — Brian W Cohen
(74) *Attorney, Agent, or Firm* — Rabin & Berdo, P.C.

(57) ABSTRACT

In a plasma electrolytic oxidation apparatus and a method of plasma electrolytic oxidation using the plasma electrolytic oxidation apparatus, the plasma electrolytic oxidation apparatus includes a chamber and an electrode unit. The chamber is configured to receive an electrolyte. The electrode unit is configured to receive the electrolyte from the chamber and to treat an object with a plasma electrolytic oxidation treatment. The electrode unit includes an electrode, an enclosing part and a cover. The electrode is configured to receive a voltage from outside, and to form a receiving space in which the electrolyte is received between the electrode and the object. The enclosing part is configured to enclose a gap between the electrode and the object. The cover is configured to cover the electrode.

14 Claims, 6 Drawing Sheets

(51) Int. Cl.

| | |
|---|---|
| ***C25D 21/04*** | (2006.01) |
| ***C25D 21/02*** | (2006.01) |
| ***C25D 11/02*** | (2006.01) |
| ***C25D 17/00*** | (2006.01) |

(52) U.S. Cl.
CPC ..... *C25D 17/004* (2013.01); *C25D 21/02* (2013.01); *C25D 21/04* (2013.01); *C25D 21/12* (2013.01)

(56) References Cited

U.S. PATENT DOCUMENTS

| | | | | |
|---|---|---|---|---|
| 9,790,611 | B2 * | 10/2017 | Yoshida | C25D 11/005 |
| 10,329,685 | B2 * | 6/2019 | Gurt Santanach | C25D 21/12 |

FOREIGN PATENT DOCUMENTS

| | | | |
|---|---|---|---|
| KR | 101596116 | B1 | 2/2016 |
| KR | 1020170093819 | A | 8/2017 |
| KR | 102126475 | B1 | 6/2020 |

* cited by examiner

PLASMA ELECTROLYTIC OXIDATION APPARATUS AND METHOD OF PLASMA ELECTROLYTIC OXIDATION USING THE SAME

This application claims priority under 35 U.S.C. § 119 to Korean Patent Application No. 10-2020-0103167, filed on Aug. 18, 2020, the disclosure of which is incorporated by reference herein in its entirety.

BACKGROUND

1. Field of Disclosure

The present disclosure of invention relates to a plasma electrolytic oxidation apparatus and a method of plasma electrolytic oxidation using the plasma electrolytic oxidation apparatus, and more specifically the present disclosure of invention relates to a plasma electrolytic oxidation apparatus and a method of plasma electrolytic oxidation using the plasma electrolytic oxidation apparatus, capable of treating a surface with attaching a movable electrolytic oxidation electrode on the surface of an object without dipping the object in a solution.

2. Description of Related Technology

Recently, to improve fuel efficiency and distance driven, various kinds of materials such as FRP (fiber reinforced polymer), aluminum (Al), magnesium (Mg) and so on are applied to a structure of a vehicle. Thus, bonding technology for different materials like the above mentioned materials has been developed.

As for the bonding technology, mechanical bonding using mechanical elements, heat bonding using a heat, or attaching via adhesive materials is normally used. However, to increase a bonding force between heterogeneous materials such as the metal and the complex material, the surface of the metal should be chemically or physically transformed.

Thus, the technology in which pores are formed via a plasma electrolytic oxidation (PEO) to induce chemical and physical transformation on a surface of the metal is in the spotlight.

However, in the conventional PEO technology, an electrolyte used in the process should be received in an additional chamber, and the object should be dipped in the chamber.

Thus, in the conventional PEO technology using the chamber, time and cost are increased to control the temperature and density of the electrolyte received in the chamber. In addition, since the object is entirely dipped in the chamber, the surface unnecessary to be treated may be damaged in the dipping. Further, after the dipping process, the electrolyte should be additionally treated with more time and cost.

Related prior art is Korean Patent No. 10-2126475.

SUMMARY

The present invention is developed to solve the above-mentioned problems of the related arts. The present invention provides a plasma electrolytic oxidation apparatus, capable of treating a surface with attaching a movable electrolytic oxidation electrode on the surface of an object without dipping the object in a solution, so as to increase process efficiency, to control the temperature and density of the electrolyte more easily, and to selectively perform the electrolytic oxidation process to the specific part of the object.

In addition, the present invention also provides a method of plasma electrolytic oxidation using the plasma electrolytic oxidation apparatus.

According to an example embodiment, the plasma electrolytic oxidation apparatus includes a chamber and an electrode unit. The chamber is configured to receive an electrolyte. The electrode unit is configured to receive the electrolyte from the chamber and to treat an object with a plasma electrolytic oxidation treatment. The electrode unit includes an electrode, an enclosing part and a cover. The electrode is configured to receive a voltage from outside, and to form a receiving space in which the electrolyte is received between the electrode and the object. The enclosing part is configured to enclose a gap between the electrode and the object. The cover is configured to cover the electrode.

In an example, the electrode may further include an attaching portion disposed to face the object and configured to be electrically insulated from the object. The enclosing part may make contact with the attaching portion.

In an example, the electrode unit may further include a first cover configured to cover the electrode, and having an insulator, and a second cover configured to cover the first cover, and having a conductor.

In an example, the object and the second cover may be grounded.

In an example, the electrode may include upper and lower portions facing each other and connected with each other, and a side portion configured to connect a side of the upper portion with a side of the lower portion, and to form the receiving space.

In an example, an upper opening portion may be formed in the upper portion, to discharge an air from the receiving space, to supply the electrolyte to the receiving space, or to discharge the electrolyte from the receiving space. A lower opening portion may be formed in the lower portion, to supply the electrolyte to the receiving space, or to discharge the electrolyte from the receiving space.

In an example, the lower opening portion may include a first lower opening portion configured to supply the electrolyte, and a second lower opening portion configured to discharge the electrolyte.

In an example, an extending length of the upper portion heading for a surface of the object may be different from an extending length of the lower portion heading for the surface of the object.

In an example, the apparatus may further include a base, and a plurality of extending portions extending from the base and having variable lengths. A plurality of the electrode units may be respectively connected to ends of the extending portions, and each of the electrode units may be disposed on each surface of the objects different from each other.

In an example, the apparatus may further include a first conduit connected to a lower opening portion of the electrode, to supply the electrolyte received in the chamber to the receiving space or to retrieve the electrolyte in the receiving space from the chamber, and a second conduit connected to an upper opening portion of the electrode, to supply the electrolyte received in the chamber to the receiving space or to retrieve the electrolyte in the receiving space from the chamber.

In an example, the chamber may include a temperature controller configured to control the temperature of the electrolyte, an inlet configured to supply the electrolyte to the chamber, and an outlet configured to discharge a gas in the chamber to an outside.

In an example, the chamber may include a first chamber configured to receive the electrolyte which treats the object, from the receiving space, a second chamber configured to supply the electrolyte which is to treat the object, to the receiving space, and a pump connected between the first chamber and the second chamber, to control a movement of the electrolyte between the receiving space and the first and second chambers.

According to another example embodiment, in a method of plasma electrolytic oxidation using the plasma electrolytic oxidation apparatus, the electrode is tightly attached to the object. A pressure of the receiving space is decreased. The electrolyte is supplied to the receiving space from the chamber. A plasma electrolytic oxidation process is performed on the object using the electrode unit. The electrolyte is discharged from the receiving space. The receiving space and the object are cleaned.

In an example, the electrolyte discharged from the receiving space may be supplied to the chamber. A reaction gas included in the electrolyte may be removed and a temperature and a density of the electrolyte may be controlled in the chamber.

In an example, the method may further include supplying a dry air to the receiving space, after the cleaning.

In an example, in the performing the plasma electrolytic oxidation process, a pressure of the receiving space may be maintained to be lower than an atmospheric pressure, to prevent the electrolyte from being leaked from the receiving space.

According to the present example embodiments, the chamber in which the electrolyte is stored and the electrode unit in which the electrolytic oxidation process is performed are divided from each other, and the receiving space in which the electrolyte is received only in the process is formed inside of the electrode unit. Thus, the conventional electrolytic oxidation process in which the object is dipped in the chamber having the electrolyte may be omitted. Further, the process efficiency may be increased, proper or movable process may be performed considering the shape or the structure of the object, and the cleaning or the drying for the object or the chamber may be omitted.

The processed electrolyte is stored in the chamber, and the temperature or the density of the electrolyte may be controlled in the chamber. In addition, the reaction gas generated in the process may be omitted. Thus, the electrolyte may be repeatedly used, and the treatment and the dealing on the electrolyte may be more easy.

In addition, the electrode is electrically insulated from the object via an attaching portion, and the second cover covering the electrode is grounded with the object, so that the object may be less damaged and the process stability may be increased in the high plasma generated process.

In addition, an upper portion of the electrode is different from a lower portion of the electrode, to attach the surface of the object having different height or structure effectively. Further, a plurality of electrodes forms a multi electrode unit, so that multi processes may be performed on multi portions of the object or various kinds of objects at the same time.

In addition, the openings are formed in the upper portion or the lower portion of the electrode, and thus the electrolyte is received and the air is discharged or supplied. Thus, the supply and the discharge processes or lines for the electrolyte and the air may be variously designed, and the chamber is divided from the process, to increased process efficiency.

In addition, the additional pump is configured, so that the pressure inside of the electrode may be controlled, the retrieval and the supply of the electrolyte may be controlled, the electrolyte may be prevented from being leaked during the process, and the plasma discharging voltage may be decreased.

Figure 1:
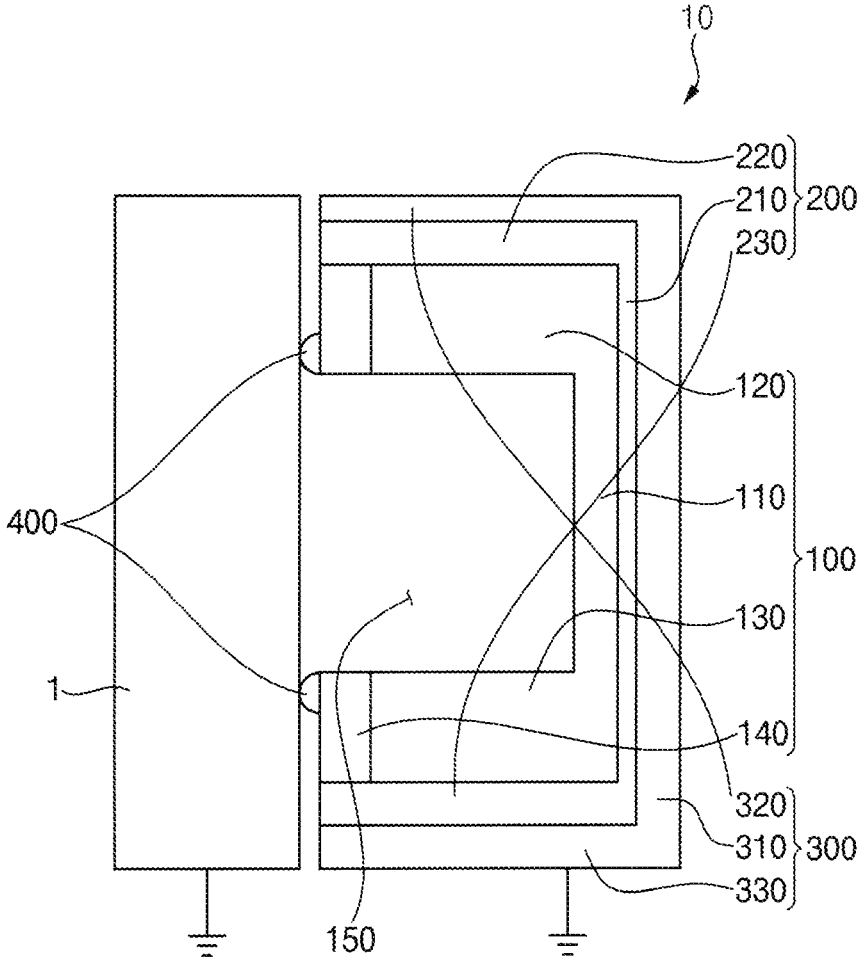
FIG. 1 is a cross-sectional view illustrating an electrode unit of a plasma electrolytic oxidation apparatus according to an example embodiment of the present invention.

| * Reference numerals | |
|---|---|
| 10, 11, 12: | electrode unit |
| 20: | multi electrode unit |
| 21: | base |
| 22: | extending portion |
| 31, 41, 42: | chamber |
| 32, 43: | electrolyte |
| 30, 40: | electrolytic oxidation apparatus |
| 100: | electrode |
| 110: | side portion |
| 120: | upper portion |
| 121: | upper opening portion |
| 130: | lower portion |
| 131, 132, 133: | lower opening portion |
| 140: | attaching portion |
| 150: | receiving space |
| 200: | first cover |
| 300: | second cover |
| 400: | enclosing part |

DETAILED DESCRIPTION

The invention is described more fully hereinafter with Reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

In the drawings, the size and relative sizes of layers and regions may be exaggerated for clarity.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The invention is described more fully hereinafter with reference to the accompanying drawings, in which embodiments of the invention are shown.

FIG. 1 is a cross-sectional view illustrating an electrode unit of a plasma electrolytic oxidation apparatus according to an example embodiment of the present invention.

Referring to FIG. 1, the plasma electrolyte oxidation apparatus (hereinafter, apparatus) includes a chamber (not shown) and an electrode unit 10.

Here, an electrolyte is stored in the chamber, and the chamber, although not shown in the figure, is divided from the electrode unit 10 and is separated from the electrode unit 10. The chamber may be explained below referring to FIG. 6, and the electrode unit 10 is firstly explained in detail.

The electrode unit 10 receives the electrolyte from the chamber, and the electrolyte from the chamber is stored in a receiving space 150.

The electrode unit 10 includes an electrode 100, a first cover 200, a second cover 300 and an enclosing part 400. The electrode unit 10 performs a plasma electrolytic oxidation (PEO) process on an object 1.

The electrode 100 forms a receiving space 450 in which the electrolyte is received, between the electrode 100 and a surface of the object 1. The electrode 100 includes a metal and receives a high voltage from an outside.

As the high voltage is applied to the electrode 100, a plasma electrolytic oxidation reaction is caused on the surface of the object 1, and here, the high voltage may be variously changed considering the process characteristics such as a DC voltage, an AC voltage, a pulse voltage and so on.

The electrode 100 has a shape to form the receiving space 150 with the surface of the object 1. For example, as illustrated in FIG. 1, the electrode 100 may include a side portion 110 facing the surface of the object 1, and upper and lower portions extending between the side portion 110 and the surface of the object 1.

Here, in FIG. 1, the electrode 100 may make contact with the object 1 extending along a vertical direction, and thus the side portion 110 facing the surface of the object 1 may be defined as explained above. However, the shape of the electrode 100 may not be limited as illustrated in FIG. 1.

Likewise, the upper and lower portions 120 and 130 may form upper and lower sides of the electrode 100 in an example of FIG. 1, and thus the upper and lower portions 120 and 130 may be defined as explained. Thus, if an opening portion heads for a lower portion, the upper and lower portions 120 and 130 may form a side portion, and the side portion 110 may form an upper portion.

In addition, the upper and lower portions 120 and 130 form a side surface of the cylindrical shape and thus the upper and lower portions 120 and 130 are integrally connected with each other. However, for the convenience of the explanation, the upper portion 120 is defined as a portion disposed over a central portion and the lower portion 130 is defined as a portion disposed under the central portion.

The electrode 100 may further include an attaching portion 140 disposed to face the object 1. In addition, the attaching portion 140 is formed at ends of the upper and lower portions 120 and 130.

The attaching portion 140 electrically insulates the electrode 100 having a metal material from the object 1, and for example, may include an insulator such as a plastic or a ceramic.

The enclosing part 400 is disposed between the attaching portion 140 and the surface of the object 1, and tightly makes contact with the surface of the object 1.

Thus, the receiving space 150 in which the electrolyte is received is enclosed, and in the plasma process, the electrolyte may be prevented from being leaked.

Here, the enclosing part 400 may be an O-ring.

The first cover 200 covers the electrode 100. Here, as illustrated in FIG. 1, if the electrode 100 includes the side portion 110, the upper portion 120 and the lower portion 130, the first cover 200 may include a side cover 210 covering the side portion 110, an upper cover 220 covering the upper portion 120 and a lower cover 230 covering the lower portion 130.

Here, the first cover 200 maintains the insulation of the electrode 100, and prevents the high voltage supplied to the electrode 100 from being leaked to increase process stability. Thus, the first cover 200 may be an insulator such as a plastic or a ceramic.

The second cover 300 covers the first cover 200. Here, as illustrated in FIG. 1, if the electrode 100 includes the side portion 110, the upper portion 120 and the lower portion 130, the second cover 300 may include a side cover 310 covering the side cover 210 of the first cover 200, an upper cover 320 covering the upper cover 220 of the first cover 200, and a lower cover 330 covering the lower cover 230 of the first cover 200.

Here, to increase the process stability, the second cover 300 may include a conductor such as a metal, different from the first cover 200. Here, the second cover 300 may be grounded with the object 1.

Figure 2:
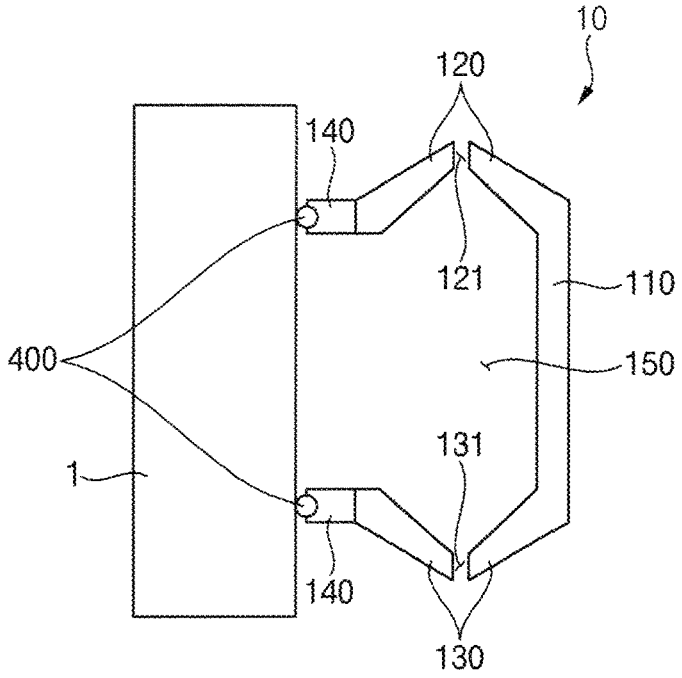
FIG. 2 is a cross-sectional view illustrating an electrode of the electrode unit of FIG. 1.

FIG. 2 is a cross-sectional view illustrating an electrode of the electrode unit of FIG. 1.

As in FIG. 2, for the convenience of the explanation, the electrode 100 is only illustrated, but the first and second covers 200 and 300 may be formed to cover the electrode 100, as illustrated in FIG. 1.

In addition, in FIG. 2, opening portions 123 and 134 are formed in the electrode 100, but opening portions like the opening portions 123 and 134 may be formed in the first and second covers 200 and 300, to supply and to discharge the electrolyte.

Referring to FIG. 2, an upper opening portion 121 is formed in the upper portion 120 of the electrode 100, and a lower opening portion 130 is formed in the lower portion 130 of the electrode 100.

In addition, although not shown in the figure, the upper and lower opening portions 121 and 131 are connected to the chamber via an additional conduit, to receive or to discharge the electrolyte, as explained below referring to FIG. 6, For example, before the plasma electrolytic oxidation process, the air in the receiving space 150 is removed through the upper opening portion 121 or the lower opening portion 131, and then the pressure of the receiving space 150 is decreased.

With the decompressing or after the decompressing, the electrolyte is supplied through the upper opening portion 121 or the lower opening portion 131, and thus the receiving space 150 is filled with the electrolyte.

Here, the decompressing is performed with the air removed through the upper opening portion 121, and the electrolyte is supplied to the receiving space 150 through the lower opening portion 131. Here, the removing of the air and the supplying of the electrolyte may be performed through the variously selected openings.

In addition, after the plasma electrolytic oxidation process, the used electrolyte may be discharged through the lower opening portion 131, and the discharged electrolyte may be provided to the chamber. Here, the electrolyte may also be discharged through the upper opening portion 121.

Further, after the discharging of the electrolyte, a cleaning liquid may be supplied through the upper opening portion 121 or the lower opening portion 131, for the cleaning of the receiving space 150 and the object 1.

Further, after the cleaning of the receiving space 150 and the object 1, a dry air is supplied through the upper opening portion 121 to dry the receiving space 150 and the object 1.

Accordingly, the upper and lower opening portions 121 and 131 are respectively formed in the upper and lower portions 120 and 130, and thus the air, the electrolyte, the cleaning liquid and so on may be supplied or discharged.

Figure 3:
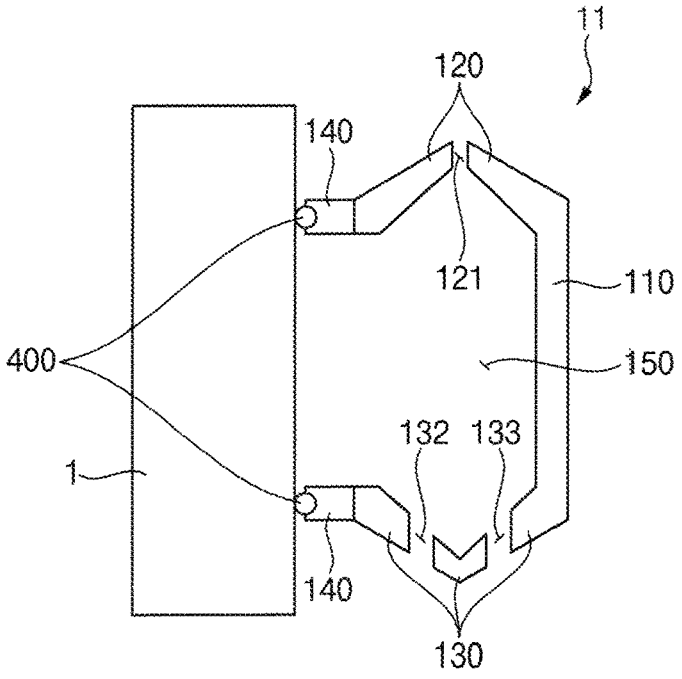
FIG. 3 is a cross-sectional view illustrating an electrode unit of a plasma electrolytic oxidation apparatus according to another example embodiment of the present invention.

FIG. 3 is a cross-sectional view illustrating an electrode unit of a plasma electrolytic oxidation apparatus according to another example embodiment of the present invention.

An electrode unit 11 in the present example embodiment is substantially same as the electrode unit 10 in the previous example embodiment of FIGS. 1 and 2, except that two opening portions are formed in the lower portion 130, and thus same reference numerals are used for the same elements and any repetitive explanation will be omitted.

Referring to FIG. 3, in the electrode unit 11 of the present example embodiment, first and second lower opening portions 132 and 133 different from each other are formed in the lower portion 130.

As the lower opening portion is divided into the first and second lower opening portions 132 and 133, the air inside of the receiving space 150 is removed through the upper opening portion 121 formed in the upper portion 121 to decrease the pressure of the receiving space 150, and the electrolyte is supplied to the receiving space 150 through the first lower opening portion 132.

Then, after the plasma electrolytic oxidation process, the electrolyte is discharged from the receiving space 150 through the second lower opening portion 133.

Likewise, in the cleaning, the cleaning liquid is supplied through the first lower opening portion 132 and after cleaning, the cleaning liquid is discharged through the second lower opening portion 133.

Accordingly, the inlet and the outlet of the electrolyte and the cleaning liquid are different from each other, so that the electrolyte and the cleaning liquid may be prevented from being polluted and the inlet and the outlet thereof may be more efficiently performed.

Figure 4:
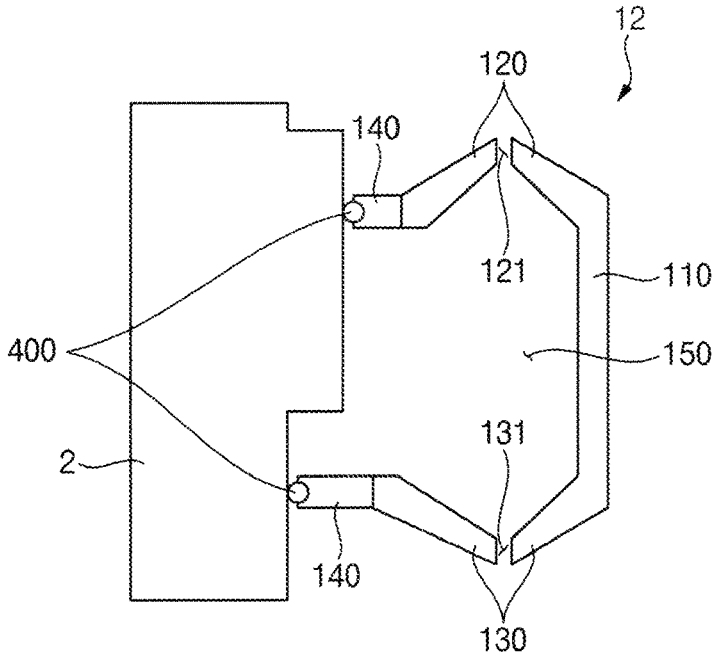
FIG. 4 is a cross-sectional view illustrating an electrode unit of a plasma electrolytic oxidation apparatus according to still another example embodiment of the present invention.

FIG. 4 is a cross-sectional view illustrating an electrode unit of a plasma electrolytic oxidation apparatus according to still another example embodiment of the present invention.

An electrode unit 12 in the present example embodiment is substantially same as the electrode unit 10 in the previous example embodiment of FIGS. 1 and 2, except that an extending length or an extending area is different in each of the upper portion 120 and the lower portion 130, and thus same reference numerals are used for the same elements and any repetitive explanation will be omitted.

Referring to FIG. 4, in the electrode unit 12 of the present example embodiment, the extending length or the extending area of the upper portion 120 is different from that of the lower portion 130.

However, in FIG. 4, a cross-section of the upper and lower portions 120 and 130 connected with each other are illustrated, and as illustrated in FIG. 4, the extending lengths or the extending areas of the upper and the lower portions 120 and 130 are different from each other, but the upper and lower portions 120 and 130 are connected in the central portion, so that the receiving space 150 is formed between the object 2 and the electrode unit 12.

Here, if the object 2 has stepped portion with a different height, the upper portion 120 or the lower portion 130 facing the stepped portion may have the extending height or the extending area to be disposed at the stepped portion.

In addition, the extending length or the extending area of each of the upper and lower portions 120 and 130 may be designed considering the shape or the structure of the object 2. Alternatively, the extending length or the extending area of the each of the upper and lower portions 120 and 130 may be designed to be changed according to the shape or the structure of the object 2.

Accordingly, the extending length or the extending area of the each of the upper and lower portions 120 and 130 are designed considering the shape or the structure of the object 2 or are designed to be changed according to considering the shape or the structure of the object 2. Thus, the receiving space 150 between the object 2 and the electrode unit may be properly enclosed, regardless of the shape or the structure of the object 2, and the plasma electrolytic oxidation process may be performed for the object 2 having various kinds of shapes or structures.

Figure 5:
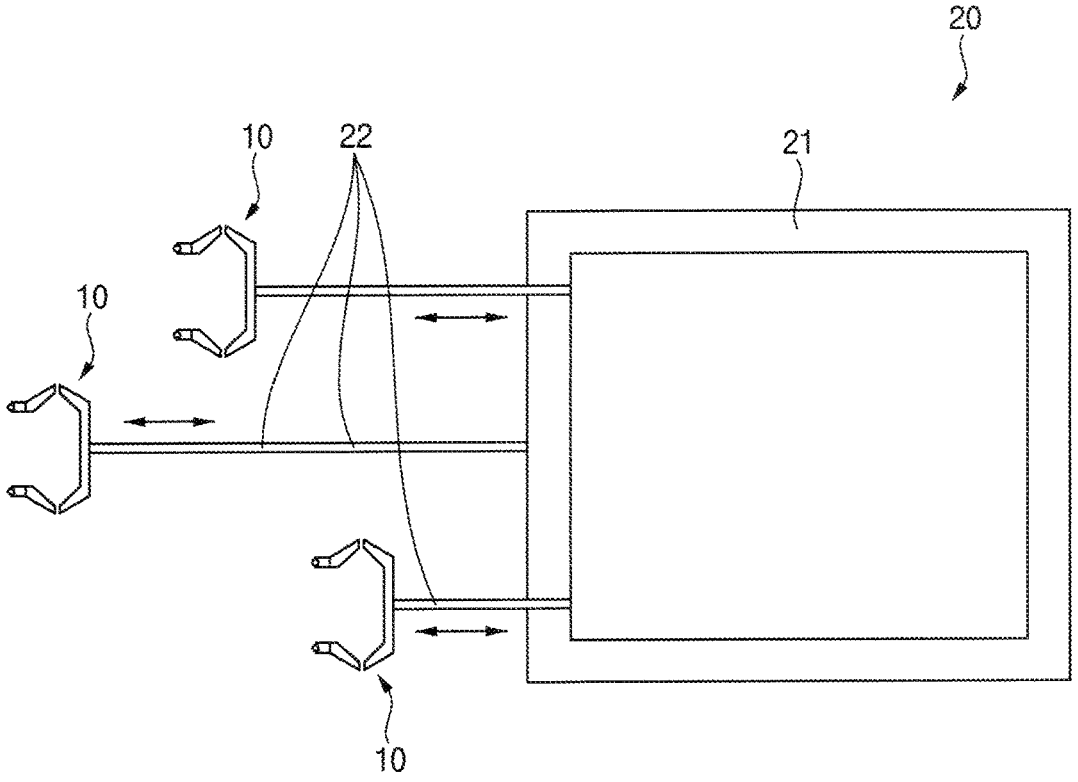
FIG. 5 is a cross-sectional view illustrating an electrode unit of a plasma electrolytic oxidation apparatus according to still another example embodiment of the present invention.

FIG. 5 is a cross-sectional view illustrating an electrode unit of a plasma electrolytic oxidation apparatus according to still another example embodiment of the present invention.

An electrode unit 20 in the present example embodiment is substantially same as the electrode unit 10 in the previous example embodiment of FIGS. 1 and 2, except that a plurality of electrode units forms a multi electrode unit, and thus same reference numerals are used for the same elements and any repetitive explanation will be omitted.

Referring to FIG. 5, the multi electrode unit 20 according to the present example embodiment includes a base 21, a plurality of extending portions 22 and a plurality of electrode units 10.

Here, in the multi electrode unit 20, a plurality of the electrode units 10 explained referring to FIG. 1 and FIG. 2 is included, and each of the electrode unit 10 is substantially same as explained above and thus any repetitive explanation will be omitted.

The base 21 has a predetermined frame structure, and a plurality of extending portions 22 is extended from the base 21. Here, each of the extending portions 22 has variable extending length, and although not shown in the figure, the base 21 may control the extending length of each of the extending portions 22.

The electrode unit 10 is individually connected to each end of the extending portions 22, and thus each electrode unit 10 performs the plasma electrolytic oxidation process on the object.

Accordingly, via the multi electrode unit 20 capable of controlling the position of each of the electrode units 10, the objects having various kinds of shapes or the plurality of objects may be treated at the same time, and thus process efficiency and the process usability may be increased.

Further, the power provided to each of the electrode unit 20 may be controlled differently, and thus the plasma electrolytic oxidation process may be properly performed according to the state of the object.

Figure 6:
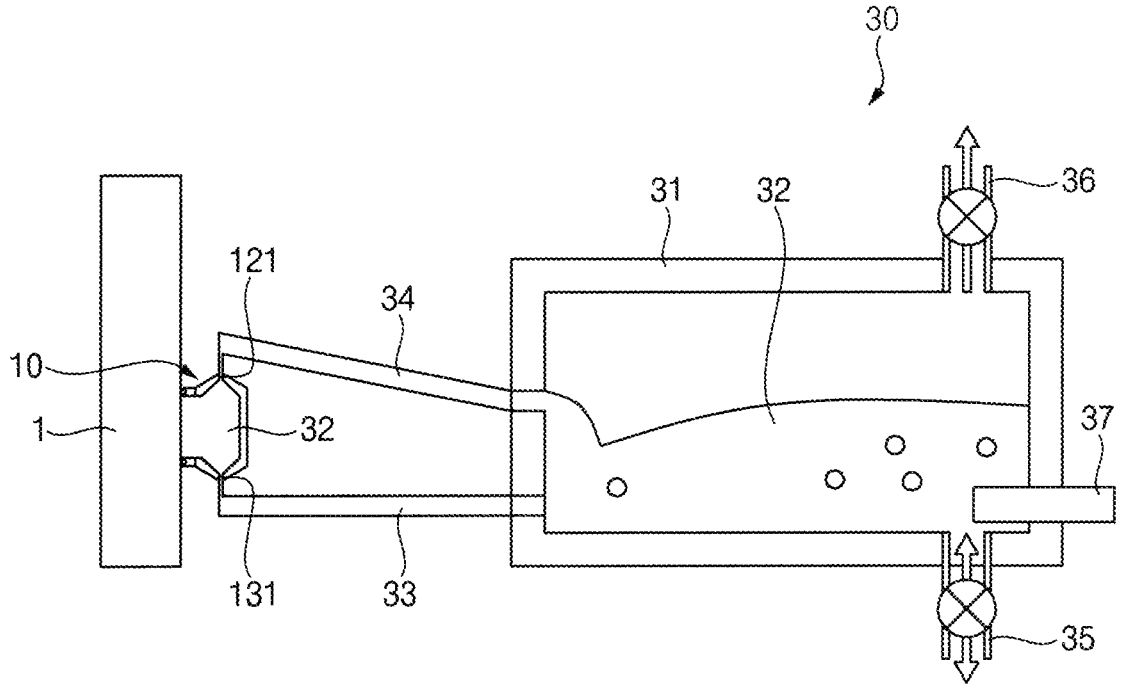
FIG. 6 is a cross-sectional view illustrating a plasma electrolytic oxidation apparatus according to still another example embodiment of the present invention.

FIG. 6 is a cross-sectional view illustrating a plasma electrolytic oxidation apparatus according to still another example embodiment of the present invention.

In the apparatus 30 according to the present example embodiment, a chamber and a conduit are designed in detail and the electrode unit 10 in the previous example embodiment of FIGS. 1 and 2 is also applied, and thus same reference numerals are used for the same elements and any repetitive explanation will be omitted.

Referring to FIG. 6, the apparatus 30 according to the present example embodiment, further includes the chamber 31 and the conduits 33 and 34, in addition to the electrode unit 10.

The electrolyte 32 is stored in the chamber 31, and the chamber 31 is separately spaced apart from the electrode unit 10.

The electrolyte 32 stored in the chamber 31 is an electrolyte to be used in the process by the electrode unit 10, or an electrolyte discharged from the electrode unit 10 after the process.

Here, if the electrolyte is the discharged electrolyte after the process, the temperature or the density of the electrolyte should be changed or controlled to be reused for the process.

Thus, the chamber 31 includes an inlet 35 through which an electrolyte is additionally supplied to the chamber 31, and the electrolyte is newly supplied to the chamber 31. In addition, the chamber 31 includes a temperature controller 37 capable of heating or cooling the electrolyte 32, so that the temperature of the electrolyte 32 may be easily controlled.

Further, the chamber 31 includes an outlet 36 through which impurities such as a discharge gas included in the electrolyte 32 is discharged after the process, and thus the impurities may be easily discharged to outside.

Accordingly, the electrolyte retrieved to the chamber 31 may be controlled to have the predetermined temperature or density for the new process. The control of the electrolyte is independently performed at the chamber 31, and thus the electrolyte is reusable. Thus, the process efficiency may be increased, and the time and cost price for controlling the electrolyte may be decreased.

For example, the chamber 31 may be connected to the lower opening portion 131 of the electrode unit 10 via a first conduit 33, and may be connected to the upper opening portion 121 of the electrode unit 10 via a second conduit 34.

Thus, as explained above, before the process in the electrode unit 10, the electrolyte 32 may be supplied to the lower opening portion 131 via the first conduit 33. In addition, after the process, the electrolyte 32 may be retrieved from the lower opening portion 131 via the first conduit 33.

Alternatively, before the process in the electrode unit 10, the electrolyte 32 may be supplied to the upper opening portion 121 via the second conduit 34. In addition, after the process, the electrolyte 32 may be retrieved from the upper opening portion 121 via the second conduit 34.

Further, the electrolyte may be supplied and retrieved through the first and second conduits 33 and 34, at the same time.

In addition, although not shown in the figure, the pumps are additionally disposed, so that the electrolyte 32 may be induced to be supplied or retrieved between the chamber 31 and the electrode unit 10.

Here, the pump may prevent the electrolyte 32 received in the receiving space 150 from being leaked during the process, and may also control the pressure of the receiving space 150.

For example, during the process, the pump may maintain the pressure of the receiving space 150 lower than an atmospheric pressure, to prevent the electrolyte 32 from being discharged from the receiving space 150.

Figure 7:
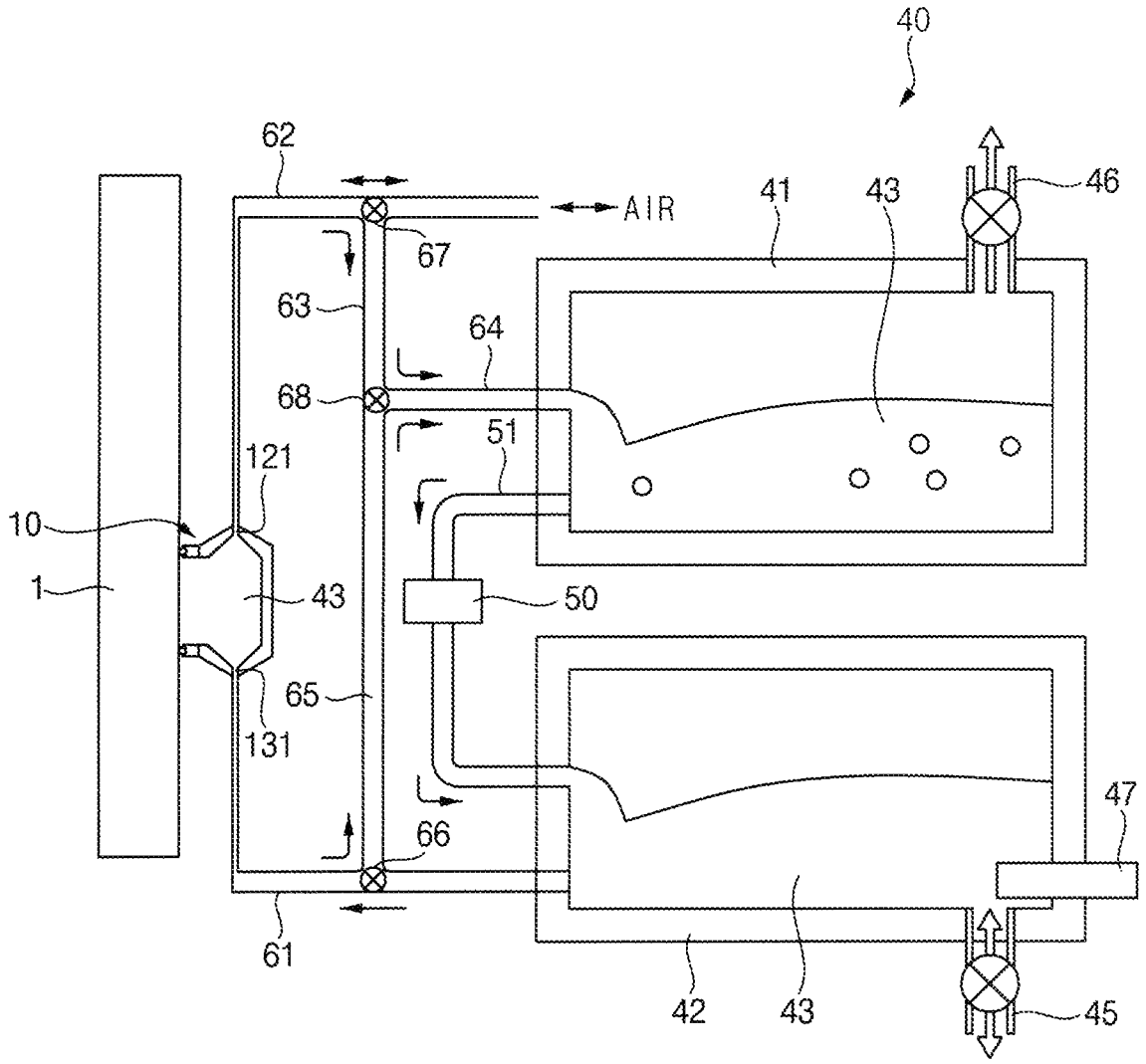
FIG. 7 is a cross-sectional view illustrating a plasma electrolytic oxidation apparatus according to still another example embodiment of the present invention.

FIG. 7 is a cross-sectional view illustrating a plasma electrolytic oxidation apparatus according to still another example embodiment of the present invention.

The apparatus 40 according to the present example embodiment is substantially same as the apparatus 30 according to the previous example embodiment of FIG. 6, except that a plurality of chambers is included and the conduits are changed, and thus same reference numerals are used for the same elements and any repetitive explanation will be omitted.

Referring to FIG. 7, the apparatus 40 according to the present example embodiment includes first and second chambers 41 and 42, a pump 50, a plurality of conduits and a plurality of valves controlling the conduits.

The first chamber 41 retrieves an electrolyte 43 after the process in the electrode unit 10 and the first chamber 41 removes a reaction gas included in the retrieved electrolyte 43 to outside.

The first chamber 41 stores and treats the retrieved electrolyte 43 after the process. After the reaction gas is removed in the first chamber 41, the electrolyte 43 moves to the second chamber 42, and then the electrolyte 43 is additionally treated for the new process.

The electrolyte 43 moved to the second chamber 42, receives an additional electrolyte from the outside via the inlet 45, and then the density of the electrolyte 43 is maintained to be used for the new process. In addition, the temperature controller 47 cools or heats the electrolyte 43 to be proper conditions for the new process.

Then, the electrolyte 43 stored in the second chamber 42 is supplied to the electrode unit 10, and then the new process is performed.

Here, the pump 50 may control the flow of the electrolyte 43 from the first chamber 41 to the second chamber 42. Further, the pump 50 may control the flow of the electrolyte between the conduits explained below, or as explained above, may prevent the electrolyte 43 from being leaked from the receiving space 150 during the process and may control the pressure of the receiving space 150.

Hereinafter, an example flow of the electrolyte between the chamber and the electrode unit via the conduits is explained. However, the example flow of the electrolyte may not be limited thereto and thus may be changed variously.

The electrolyte 43 stored in the second chamber 42 and controlled to be predetermined temperature and density, is supplied to the receiving space 150 passing through the lower opening portion 131 via the first conduit 61.

Here, the first valve 66 disposed at the first conduit 61 may be selectively open or closed to flow or to block the flow of the electrolyte toward the receiving space 150.

Before the supply of the electrolyte, the air inside of the receiving space 150 may be removed to decrease the pressure of the receiving space 150, through the second conduit 62 connected to the upper opening portion 121.

Then, after the process, the electrolyte 43 stored in the receiving space 150 is discharged via the lower opening portion 131 along the first conduit 61. Here, according to an operation of the first valve 66, the electrolyte 43 may be flowed into the fifth conduit 65 and according to an operation of the third valve 68, the electrolyte 43 may be finally flowed to the first chamber 41 along the fourth conduit 64.

Likewise, after the process, the electrolyte 43 may be discharged through the upper opening portion 121. The discharged electrolyte 43 is discharged through the second conduit 62 and is flowed into the third conduit 62 according to an operation of the second valve 67. Likewise, according to an operation of the third valve 68, the discharged electrolyte 43 is finally provided to the first chamber 41 along the fourth conduit 64.

Further, although not shown in the figure, an additional cleaning liquid may be supplied to the receiving space 150 after the process, and the supply and the discharge of the cleaning liquid may be the same as those of the electrolyte.

After the cleaning is finished and the cleaning liquid is also removed from the receiving space 150, the second valve 67 is operated so that a dry air may be supplied to the receiving space 150 from the outside. Then, the drying may be performed on the receiving space 150 and the object 1.

Figure 8:
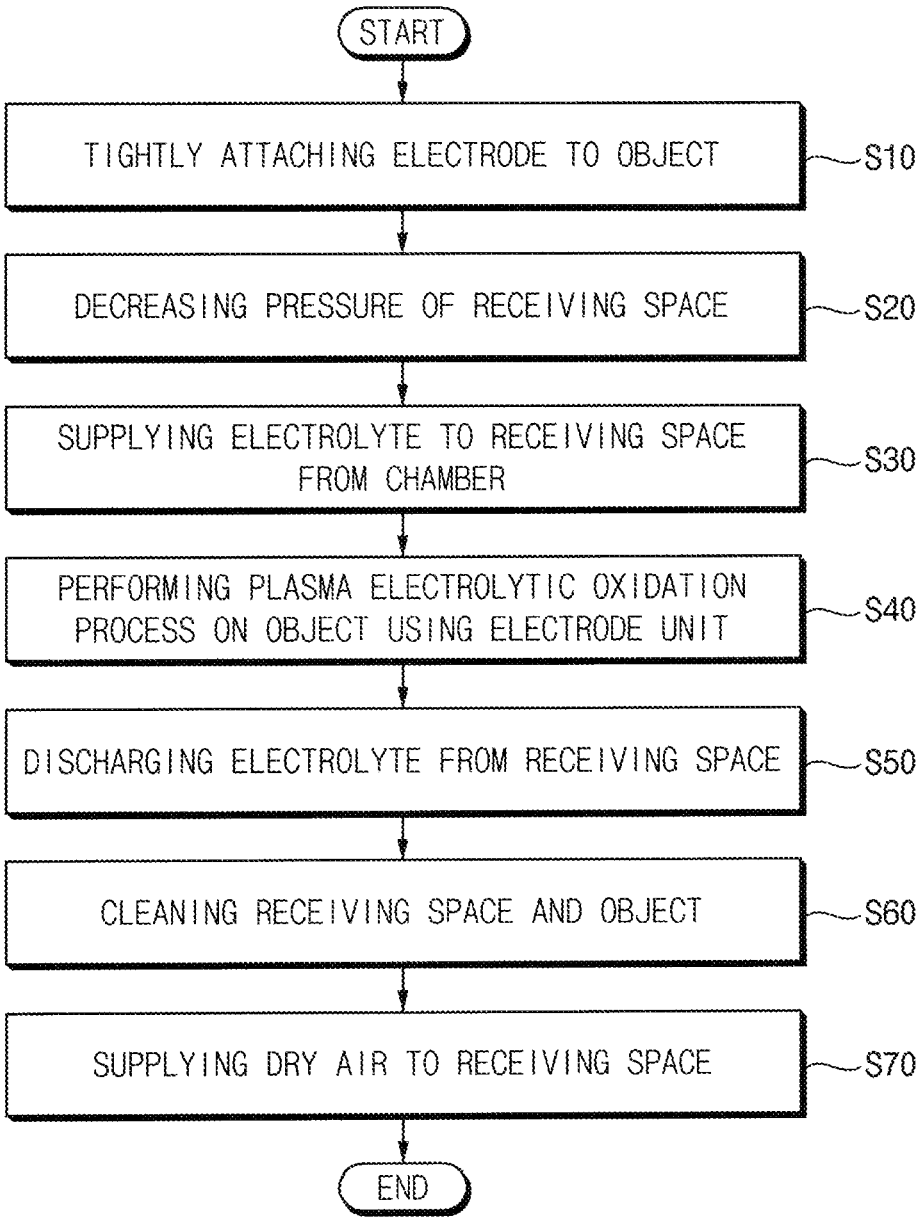
FIG. 8 is a flow chart showing a method of plasma electrolytic oxidation using the plasma electrolytic oxidation apparatus of FIG. 1.

FIG. 8 is a flow chart showing a method of plasma electrolytic oxidation using the plasma electrolytic oxidation apparatus of FIG. 1.

Referring to FIG. 8, in the method of plasma electrolyte oxidation, the electrode 100 of the electrode unit 10 is tightly attached to the surface of the object 1 (step S10).

Here, the enclosing part 400 is disposed between the attaching portion 140 and the surface of the object 1, and thus the receiving space 150 is enclosed.

Then, the pressure of the receiving space 150 is decreased (step S20). For the decompressing of the receiving space 150, the air inside of the receiving space 150 may be discharged to the outside through the upper opening portion 121, and here, an additional decompressing pump may be used.

Then, the electrolyte is supplied to the receiving space 150 from the chamber (step S30). Since the pressure of the receiving space 150 is decreased, the electrolyte is easily supplied to the receiving space 150, and here, an additional pump may be used for the supply of the electrolyte.

Here, the electrolyte may be supplied via the lower opening portion 131 or via the upper opening portion 121 as explained above.

Then, the electrode unit 10 performs the plasma electrolytic oxidation process on the object 1 (step S40).

During the process, an additional pump is operated to maintain the pressure of the receiving space 150 lower than the atmospheric pressure, to prevent the electrolyte from being leaked from the receiving space 150. Thus, the leakage of the electrolyte may be minimized.

Then, the electrolyte is discharged from the receiving space 150 (step S50). As explained above, the electrolyte may be discharged via the lower opening portion 131 or the upper opening portion 121, and the discharged electrolyte may be provided to the chamber.

Here, for the reuse of the electrolyte, an additional process for maintaining the temperature or the density of the electrolyte and for removing the impurities may be performed. Here, the chamber is separated and spaced apart from the electrode unit, and thus the additional process may be easily and independently performed.

Then, the receiving space 150 and the object are cleaned (step S60). The supply and the discharge of the cleaning liquid for the cleaning may be performed as those of the electrolyte. Here, the supply and the discharge of the cleaning liquid may be performed between the chamber in which the cleaning liquid is stored and the receiving space.

Then, the dry air is supplied to the receiving space 150 (step S70).

As the dry air is supplied to the receiving space 150, the receiving space 150 and the object are dried, and the plasma electrolytic oxidation process is finished.

Here, the dry air may be supplied via the upper opening portion 121, as explained above.

According to the present example embodiments, the chamber in which the electrolyte is stored and the electrode unit in which the electrolytic oxidation process is performed are divided from each other, and the receiving space in which the electrolyte is received only in the process is formed inside of the electrode unit. Thus, the conventional electrolytic oxidation process in which the object is dipped in the chamber having the electrolyte may be omitted. Further, the process efficiency may be increased, proper or movable process may be performed considering the shape or the structure of the object, and the cleaning or the drying for the object or the chamber may be omitted.

The processed electrolyte is stored in the chamber, and the temperature or the density of the electrolyte may be controlled in the chamber. In addition, the reaction gas generated in the process may be omitted. Thus, the electrolyte may be repeatedly used, and the treatment and the dealing on the electrolyte may be more easy.

In addition, the electrode is electrically insulated from the object via an attaching portion, and the second cover covering the electrode is grounded with the object, so that the object may be less damaged and the process stability may be increased in the high plasma generated process.

In addition, an upper portion of the electrode is different from a lower portion of the electrode, to attach the surface of the object having different height or structure effectively. Further, a plurality of electrodes forms a multi electrode unit, so that multi processes may be performed on multi portions of the object or various kinds of objects at the same time.

In addition, the openings are formed in the upper portion or the lower portion of the electrode, and thus the electrolyte is received and the air is discharged or supplied. Thus, the supply and the discharge processes or lines for the electrolyte and the air may be variously designed, and the chamber is divided from the process, to increased process efficiency.

In addition, the additional pump is configured, so that the pressure inside of the electrode may be controlled, the retrieval and the supply of the electrolyte may be controlled, the electrolyte may be prevented from being leaked during the process, and the plasma discharging voltage may be decreased.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A plasma electrolytic oxidation apparatus comprising:
a chamber configured to receive an electrolyte; and
an electrode unit configured to receive the electrolyte from the chamber and to treat an object with a plasma electrolytic oxidation treatment,
wherein the electrode unit comprises:
an electrode configured to receive a voltage from outside, and to form a receiving space in which the electrolyte is received between the electrode and the object;
an enclosing part configured to enclose a gap between the electrode and the object; and
a cover configured to cover the electrode;
wherein the electrode comprises:
upper and lower portions facing each other and connected with each other;
a side portion configured to connect a side of the upper portion with a side of the lower portion and to form the receiving space;
wherein an upper opening portion is formed in the upper portion, to discharge air from the receiving space, to supply the electrolyte to the receiving space, or to discharge the electrolyte from the receiving space, and
wherein a lower opening portion is formed in the lower portion, to supply the electrolyte to the receiving space, or to discharge the electrolyte from the receiving space.

2. The apparatus of claim 1, wherein the electrode further comprises:
an attaching portion disposed to face the object and configured to be electrically insulated from the object,
wherein the enclosing part makes contact with the attaching portion.

3. The apparatus of claim 1, wherein the electrode unit further comprises:
a first cover configured to cover the electrode, and having an insulator; and
a second cover configured to cover the first cover, and having a conductor.

4. The apparatus of claim 3, wherein the object and the second cover are grounded.

5. The apparatus of claim 1, wherein the lower opening portion comprises:
a first lower opening portion configured to supply the electrolyte, and a second lower opening portion configured to discharge the electrolyte.

6. The apparatus of claim 1, wherein an extending length of the upper portion heading for a surface of the object is different from an extending length of the lower portion heading for the surface of the object.

7. The apparatus of claim 1, further comprising:
a base; and
a plurality of extending portions extending from the base and having variable lengths,
wherein a plurality of the electrode units is respectively connected to ends of the extending portions, and each of the electrode units is disposed on each surface of the objects different from each other.

8. The apparatus of claim 1, further comprising:
a first conduit connected to a lower opening portion of the electrode, to supply the electrolyte received in the chamber to the receiving space or to retrieve the electrolyte in the receiving space from the chamber; and
a second conduit connected to an upper opening portion of the electrode, to supply the electrolyte received in the chamber to the receiving space or to retrieve the electrolyte in the receiving space from the chamber.

9. The apparatus of claim 1, wherein the chamber comprises:
a temperature controller configured to control the temperature of the electrolyte;
an inlet configured to supply the electrolyte to the chamber; and
an outlet configured to discharge a gas in the chamber to an outside.

10. The apparatus of claim 1, wherein the chamber comprises:
a first chamber configured to receive the electrolyte which treats the object, from the receiving space;
a second chamber configured to supply the electrolyte which is to treat the object, to the receiving space; and
a pump connected between the first chamber and the second chamber, to control a movement of the electrolyte between the receiving space and the first and second chambers.

11. A method of plasma electrolytic oxidation using the plasma electrolytic oxidation apparatus of claim 1, the method comprising:
tightly attaching the electrode to the object;
decreasing a pressure of the receiving space;
supplying the electrolyte to the receiving space from the chamber;
performing a plasma electrolytic oxidation process on the object using the electrode unit;
discharging the electrolyte from the receiving space; and
cleaning the receiving space and the object.

12. The method of claim 11, wherein the electrolyte discharged from the receiving space is supplied to the chamber,
wherein a reaction gas included in the electrolyte is removed and a temperature and a density of the electrolyte are controlled in the chamber.

13. The method of claim 11, further comprising:

supplying a dry air to the receiving space, after the cleaning.

14. The method of claim 11, wherein in the performing the plasma electrolytic oxidation process, a pressure of the receiving space is maintained to be lower than an atmospheric pressure, to prevent the electrolyte from being leaked from the receiving space.

* * * * *